US009069369B1

(12) United States Patent
Liu et al.

(10) Patent No.: US 9,069,369 B1
(45) Date of Patent: Jun. 30, 2015

(54) VOLTAGE REGULATOR AND A METHOD TO OPERATE THE VOLTAGE REGULATOR

(75) Inventors: Ping-Chen Liu, Fremont, CA (US); Justin Jon Philpott, San Francisco, CA (US); Arvind Sherigar, Santa Clara, CA (US)

(73) Assignee: Altera Corporation, San Jose, CA (US)

( * ) Notice: Subject to any disclaimer, the term of this patent is extended or adjusted under 35 U.S.C. 154(b) by 129 days.

(21) Appl. No.: 13/436,660

(22) Filed: Mar. 30, 2012

(51) Int. Cl.
*G05F 1/00* (2006.01)
*G05F 1/56* (2006.01)
*G05F 1/567* (2006.01)

(52) U.S. Cl.
CPC .. *G05F 1/56* (2013.01); *G05F 1/567* (2013.01)

(58) Field of Classification Search
USPC ..... 323/265–269, 273–277, 279, 281
See application file for complete search history.

(56) References Cited

U.S. PATENT DOCUMENTS 4,665,356 A * 5/1987 Pease ..... 323/314
5,295,161 A * 3/1994 Dreps et al. ..... 375/318
5,412,309 A * 5/1995 Ueunten ..... 323/316
5,627,458 A * 5/1997 Nevin ..... 323/267
6,433,521 B1 * 8/2002 Chen et al. ..... 323/224
7,068,103 B2 * 6/2006 Lind ..... 330/251
7,362,079 B1 * 4/2008 Maheedhar et al. ..... 323/269
7,420,359 B1 * 9/2008 Anderson et al. ..... 323/316
8,129,967 B2 * 3/2012 Blisson et al. ..... 323/280
2003/0223254 A1 * 12/2003 Xu et al. ..... 363/73
2007/0146051 A1 * 6/2007 Tsen ..... 327/536
2011/0181361 A1 * 7/2011 Nolan et al. ..... 330/278

* cited by examiner

*Primary Examiner* — Adolf Berhane
*Assistant Examiner* — Henry Lee, III
(74) *Attorney, Agent, or Firm* — Womble, Carlyle, Sandridge & Rice

(57) ABSTRACT

A voltage regulator is disclosed. The voltage regulator includes an operational amplifier (op-amp) and a voltage trim circuit. The op-amp is operable to receive a reference voltage at a first terminal. The op-amp also includes an output terminal. The voltage trim circuit is coupled between the output terminal and a second terminal of the op-amp. The voltage trim circuit is operable to modify an output voltage to be substantially equivalent with the reference voltage. The modification is performed by selecting an electrical current propagating pathway. An IC and a method to operate the voltage regulator is also disclosed.

21 Claims, 5 Drawing Sheets

VOLTAGE REGULATOR AND A METHOD TO OPERATE THE VOLTAGE REGULATOR

BACKGROUND

A voltage regulator circuit may be utilized for generating a steady voltage. The steady voltage may be required for circuitry, e.g. integrated circuits (ICs), which are highly susceptible to voltage variations. It is crucial that the voltages supplied to the ICs are always within a bounded range, so that the ICs may behave consistently.

Manufacturing variations may affect the voltage regulators function. The manufacturing variation, however, may be corrected through a trimming process. Trimming process is a standard method applicable to an IC to modify voltage output for minor deviations. The problem with most trimming processes is the requirement of variable resistor at the voltage regulator output terminal. The placement may affect the voltage regulators gain, which is not desired.

It is within this context that the embodiments described herein arise.

SUMMARY

The embodiments described herein describe a voltage regulator and a method to operate the voltage regulator. Several embodiments are described below.

In one embodiment, a voltage regulator is described. The voltage regulator includes an operational amplifier (op-amp) and a voltage trim circuit. The op-amp receives a reference voltage on its first terminal. The op-amp also includes an output terminal. The voltage trim circuit is coupled between the output terminal and a second terminal of the op-amp. The voltage trim circuit is operable to modify an output voltage on the output terminal so that the output voltage is substantially equivalent with the reference voltage. The voltage trim circuit modifies the output voltage by controlling an electrical current propagating within the voltage trim circuit.

In another embodiment, an Integrated Circuit (IC) is described. The IC includes a first op-amp and a second op-amp where a positive terminal of the first and second op-amps is coupled to a reference voltage source. The IC also includes a first trim circuit and a second trim circuit. The first trim circuit is coupled between an output terminal of first op-amp and a negative terminal of the first op-amp. The second trim circuit is coupled between an output terminal of second op-amp and a negative terminal of second op-amp. Both the first and second trim circuits are operable to trim the output voltages of the first and second op-amp, respectively. The trimming may be performed by selecting an electrical current propagating pathway within respective voltage trim circuits.

In another embodiment, a method to operate the voltage regulator is described. The method includes receiving a reference voltage on a first input terminal of an op-amp. Next, it is determined if an output voltage of the op-amp requires a voltage level modification. A direction of an electrical current in a voltage trim circuit that enables trimming of the output voltage by a predetermined voltage is selected. The output voltage is the output from the voltage regulator.

Other aspects of the embodiments will become apparent from the following detailed description, taken in conjunction with the accompanying drawings, illustrated by way of example.

BRIEF DESCRIPTION OF THE DRAWINGS

The embodiment may be understood by reference to the following description taken in conjunction with the accompanying drawings.

DETAILED DESCRIPTION

The following embodiments describe a voltage regulator and a method to operate the voltage regulator. It will be obvious, however, to one skilled in the art, that the present embodiments may be practiced without some or all of these specific details. In other instances, well-known operations have not been described in detail in order not to unnecessarily obscure the present embodiments.

The embodiments described below illustrate a voltage regulator. The voltage regulator may include an operational amplifier that generates an output at a particular voltage, and a voltage trimming circuit that may trims the output by a delta voltage. The trimming may be a result of an electrical current propagating in a particular direction within the voltage trimming circuit. The voltage regulator, in this embodiment, may not affect an input voltage as a result of trimming.

Figure 1:
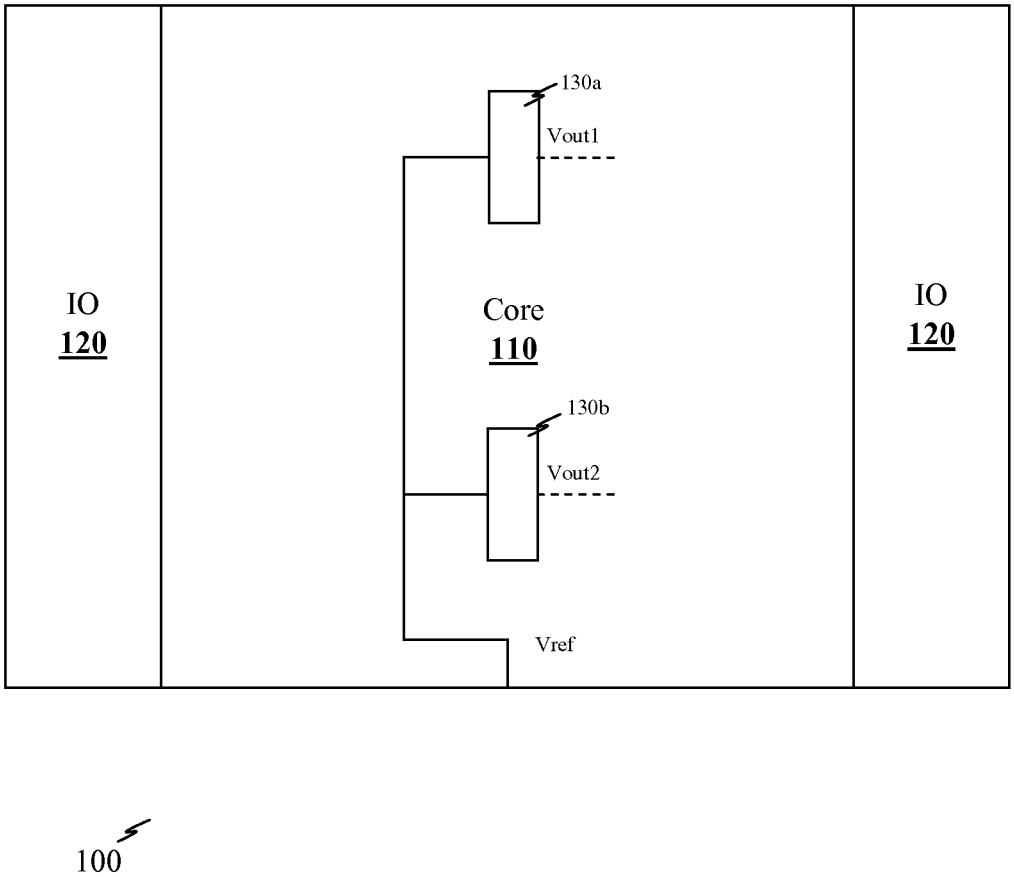
FIG. 1, meant to be illustrative and not limited to, illustrates an Integrated Circuit (IC) with voltage regulators in accordance to one embodiment.

FIG. 1, meant to be illustrative and not limiting, illustrates an integrated circuit (IC) in accordance with one embodiment. In one embodiment, IC 100 may be a Programmable Logic Device (PLD), e.g., Field Programmable Gate Array (FPGA). In one embodiment, IC 100 may perform a plurality of electrical functions. It should be appreciated that IC 100 may be manufactured utilizing semiconductor manufacturing processes.

IC 100 includes core 110 and a plurality of IOs 120. Core 110 may execute functions that define IC 100. IOs 120 may enable transferring of electrical signals between IC 100 and external circuitry (e.g. tester or another IC, which are not illustrated in FIG. 1). In the embodiment of FIG. 1, IOs 120 are located on the left and right peripheral regions of IC 100 and core 110 is located in a middle portion of IC 100.

In one embodiment, core 110 includes a plurality of programmable logic elements. The programmable logic elements may be programmable to execute electrical functions. It should be appreciated, however, that the circuitry that defines core 110 may vary depending on IC 100, e.g., core 110 of a memory IC may include a plurality of storage element circuitry.

Core 110 may further include circuits that may regulate the conditions of IC 100. In the exemplary embodiment of FIG. 1, core 110 includes voltage regulators 130*a* and 130*b*. Voltage regulators 130*a* and 130*b* may provide steady voltages at a predefined voltage level, where IC 100 may function optimally. It should be appreciated that the predefined voltage level may be within a bounded range defined between an upper voltage limit and a lower voltage limit and may be subjected to manufacturing technologies.

In one embodiment, voltage regulators 130*a* and 130*b* may be utilized to supply a steady voltage to the remaining circuits of IC 100. In the exemplary embodiment of FIG. 2, voltage regulator 130*a* supplies voltages to the upper half of IC 100 and voltage regulator 130*b* supplies voltages to the lower half of IC 100. It should be appreciated that the both supplied voltages are substantially equivalent. In an exemplary embodiment, when IC 100 is a PLD, voltage regulators 130*a* and 130*b* may supply voltage to programmable logic elements. Furthermore, the voltages may be supplied as a supply voltage (Vcc) to configuration random access memories (CRAMs) of the PLD.

In one embodiment, voltage regulators 130*a* and 130*b* receive a reference voltage (Vref) from an external voltage source, e.g., external power source. In another embodiment, however, the Vref may be an output from a Bipolar Junction Transistor (BJT) within IC 100. The Vref voltage level may be in a range between about 0.5V and 0.7V, in one exemplary embodiment. Voltage regulators 130*a* and 130*b* receiving the Vref may generate an output that has a voltage level based on the Vref. In one embodiment, voltage regulator 130*a* generates an output, e.g. Vout1, and voltage regulator 130*b* generates an output, e.g. Vout2.

It shall be appreciated that semiconductor manufacturing variations may impact the electrical characteristics of voltage regulators 130*a* and 130*b*. As a consequence, voltage regulators 130*a* and 130*b* may generate different voltage level for Vout1 and Vout2 even when tied to a single voltage source. The output, e.g., Vout1 and Vout2, may not be equivalent to a predefined voltage level. It should be appreciated, however, that the Vout1 and Vout2 may be adjusted in such manner so that Vout1 and Vout2 may become substantially identical to the predefined voltage through a trimming process.

Figure 2:
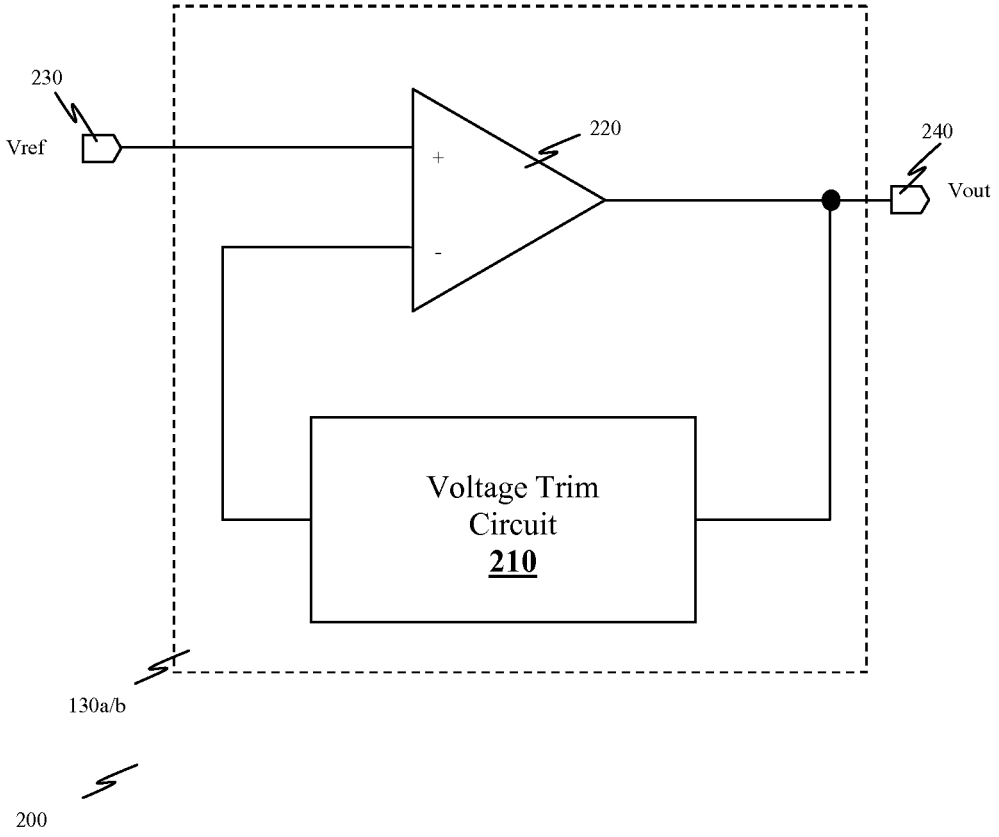
FIG. 2, meant to be illustrative and not limited to, illustrates a voltage regulator in accordance with one embodiment.

FIG. 2, meant to be illustrative and not limiting, illustrates a voltage regulator in accordance with one embodiment. It should be appreciated that voltage regulator 130*a/b* may refer to voltage regulator 130*a* or voltage regulator 130*b* of FIG. 1. Voltage regulator 130*a/b* may receive Vref voltage at input terminal 230 and outputs a Vout voltage from output terminal 240. In one exemplary embodiment, voltage regulator 130*a/b* may be detailed implementations of voltage regulator 130*a* or 130*b* of FIG. 1.

In one embodiment, voltage regulator 130*a/b* includes operational amplifier (op-amp) circuit 220 and voltage trimming circuit 210. Op-amp circuit 220 includes a positive input terminal, a negative input terminal and an output terminal. The positive input terminal of op-amp circuit 220 receives Vref from input terminal 230 and the negative input terminal of op-amp circuit 220 receives an output of voltage trimming circuit 210. In one embodiment, op-amp circuit 220 amplifies a difference between voltages (Δv) received at the positive terminal and the negative terminal of op-amp circuit 220. It should be appreciated that the voltage difference may be amplified by an amplification factor (Ao).

In one embodiment, op-amp circuit 220 has an amplification factor of '1', i.e., unity gain amplification factor. It shall be appreciated that op-amp circuit 220 achieves unity gain amplification factor by coupling the output terminal of op-amp circuit 220 to the negative input terminal of op-amp circuit 220. In one embodiment, the voltage received by the negative terminal of op-amp circuit 220 is denoted as feedback voltage (Vfb). The Vfb and Vout voltage levels are identical, in one embodiment. As a result of unity gain amplification factor, op-amp circuit 220 includes high input impedance at its input terminals and low impedance at its output terminal. The impedances prevent an electrical current to propagate into the input terminals of op-amp circuit 220. The unity gain amplification factor may further provide voltage-following characteristic, where the output voltage, e.g., Vout, is substantially similar, if not identical, to the input voltage, e.g., Vin.

In the embodiment of FIG. 2, voltage trimming circuit 210 may be coupled between output terminal 240 and the negative input terminal of op-amp circuit 220. Voltage trimming circuit 210 may trim the Vout to be substantially identical to Vref. In one embodiment, the Vout may be trimmed by selecting the appropriate pathway for an electrical current to propagate within voltage trimming circuit 210. In one exemplary embodiment, the selected pathway may increase the Vout by a predetermined amount of voltage, e.g., $\Delta V_1$. In an alternative exemplary embodiment, the selected pathway may decrease the Vout by a different predetermined amount of voltage, e.g., $\Delta V_2$. In one embodiment, the $\Delta V_1$ and $\Delta V_2$ may be different because of the differences in the amount of electrical current propagating across the selected pathways.

Figure 3:
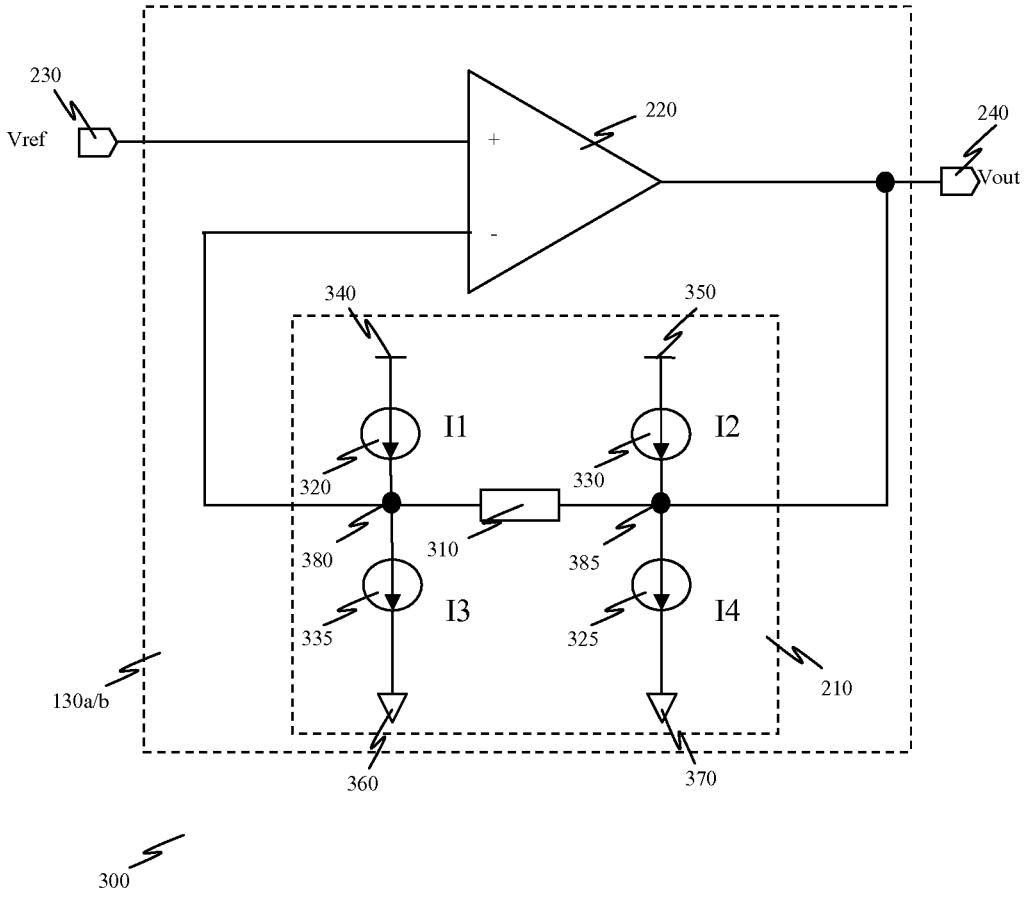
FIG. 3, meant to be illustrative and not limited to, illustrates a voltage regulator with implementation details of the voltage trimming circuit in accordance with one embodiment.

FIG. 3, meant to be illustrative and not limiting, illustrates an implementation of voltage trimming circuit 210 in accordance with one embodiment. In one embodiment, voltage trimming circuit 210 includes two electrical current sources, e.g., current sources 320 and 330, and two current sinks, e.g., current sinks 325 and 335. Voltage trimming circuit 210 further includes a resistor, e.g., Rtrim 310.

In one embodiment, current source 320 and 330 may be utilized for generating a steady electrical current. It should be appreciated that the stable voltage source may be applied to terminals 340 and 350. In an exemplary embodiment, current sources 320 and 330 may generate corresponding electrical currents, e.g., I1 and I2. The I1 and I2 may have different electrical current value in one embodiment. The difference may be due to differences in the configuration for respective current sources 320 and 330.

Current sinks 325 and 335, on the other hand, may be utilized for sinking a steady electrical current to the ground. In one embodiment, current sinks 325 and 335 may be utilized for sinking the corresponding electrical currents, e.g., I3 and I4, to the ground through the respective ground terminals, e.g., terminals 360 and 370. The electrical current value for respective electrical currents I3 and I4 may also be different in one embodiment. Similar to current sources 320 and 330, the difference for the respective electrical currents I3 and I4 may be due to differences in the configuration for current sinks 325 and 335.

In the embodiment of FIG. 3, current sources 320 and 330 and current sinks 325 and 335 may be coupled to corresponding intersecting points 380 or 385 that are available on a feedback pathway. The feedback pathway is an electrical pathway that couples the output terminal and the negative terminal of op-amp circuit 220. Rtrim 310 may be disposed on the feedback pathway, especially between intersecting points 380 and 385.

The input terminals of current sources 320 and 330 are coupled to terminals 340 and 350 respectively. Terminals 340 and 350 are applied with voltage, e.g., Vcc. In the embodiment of FIG. 3, the output terminal of current source 320 is coupled with intersecting point 380. The output terminal of current source 330 is coupled with intersecting point 385. It should be appreciated that intersecting point 380 is further coupled to a terminal of Rtrim 310 and the input terminal of current sink 335. Whereas, intersecting point 385 is coupled to another of the terminal of Rtrim 310 and the input terminal of current sink 325. The output terminals of current sinks 325 and 335 are coupled to terminals 370 and 360, respectively.

In one embodiment, the selected pathway for the purpose of trimming includes a pathway that includes current source 320, Rtrim 310 and current sink 325. The electrical current generated by current source 320 may propagate through Rtrim 310, current sink 325 and to ground via terminal 370. In another embodiment, the selected pathway for the purpose of trimming includes a pathway that includes current source 330, Rtrim 310 and current sink 335. The electrical current generated by current source 330 may propagate through Rtrim 310, current sink 335 to ground via terminal 360.

In one embodiment, the selected pathway may be selected through activating the appropriate current source 320 or 330 and current sink 325 or 335. In one embodiment, the selected pathway that includes current source 320, current sink 325 and Rtrim 310 may be selected by activating current source 320 and current sink 325. In an alternative embodiment, the selected pathway that includes current source 330, current sink 335 and Rtrim 310 may be selected by activating current source 330 and current sink 335. It should be appreciated that the Vout may be trimmed by activating current source 320 and current sink 325 in one instance or by activating current source 330 and current sink 335 in another instance.

It should be appreciated that the electrical current I1 may be identical with the electrical current I3 or the electrical current I2 may be identical with the electrical current I4. The electrical currents, I1 and I3 in one instance or I2 and I4 in another instance, are substantially identical so that it may prevent any electrical current propagating through the output terminal of the op-amp circuit 220.

It should also be appreciated that when none of current sources 320 and 330 or current sinks 325 and 335 are active, the output voltage is at an initial output voltage, $Vout_{ini}$. In one embodiment, current source 320 and current sink 325 are activated. The $Vout_{ini}$ may be trimmed down by $\Delta V_1$. The electrical current generated by current source 320, which is I1, propagates through Rtrim 310, current sink 325 and be output to the ground via terminal 370. The generated $\Delta V_1$ across Rtrim 310 may be applied negatively to final output. Therefore, the final output voltage may be $Vout_{fin}=Vout_{ini}-\Delta V_1$.

In another embodiment, current source 330 and current sink 335 are activated. The $Vout_{ini}$ may be added by $\Delta V_2$ in this embodiment. The electrical current generated by current source 330, which is I2, propagates through Rtrim 310, current sink 335 and be output to the ground via terminal 360. The generated $\Delta V_2$ across Rtrim 310 may be applied positively to the final output. Therefore, the final output voltage may be $Vout_{fin}=Vout_{ini}+\Delta V_2$. It should be appreciated that $\Delta V_1$ may be is a product of I1×resistance of Rtrim 310 and $\Delta V_2$ is a product of I2×resistance of Rtrim 310.

It should appreciated that the electrical currents generated by current sources 320 and 330 may be controlled via fuses. The fuses are set to a specific configuration, which determines the amount of electrical current I1 or I2 that is generated. In one embodiment, the fuses may be antifuses, which are blown to a specific configuration. In one exemplary embodiment, current sources 320 and 330 have at least eight different electrical current values with the available fuses. The ability to generate different electrical current values for corresponding I1 or I2 provides flexibility in terms of trim step $\Delta V_1$ and $\Delta V_2$. Therefore, voltage trimming circuit 210 may be able to trim even when there is substantial offset compared to the predefined voltage.

Figure 4:
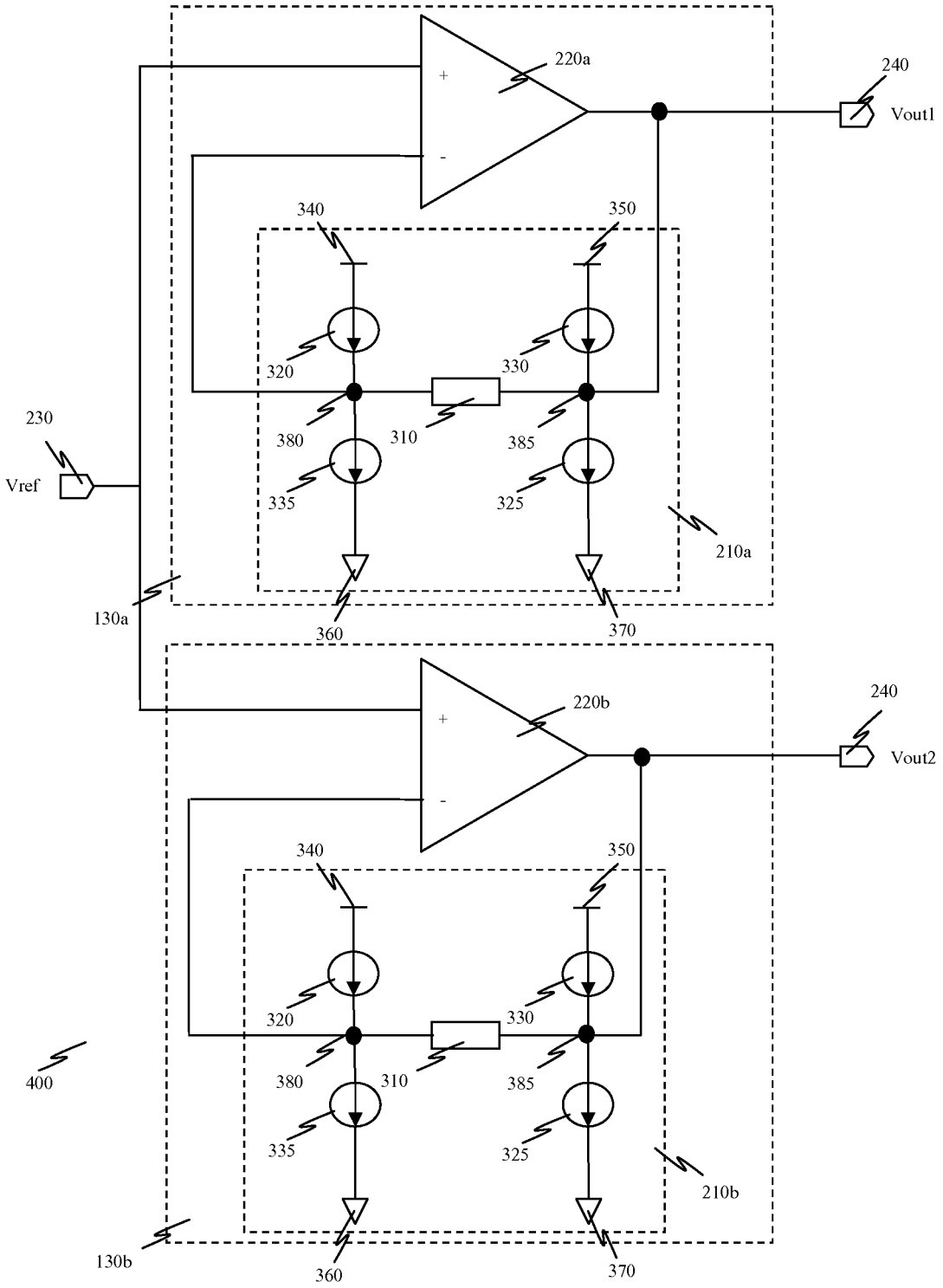
FIG. 4, meant to be illustrative and not limited to, illustrates voltage regulators coupled to a single reference voltage in accordance with one embodiment.

FIG. 4, meant to be illustrative and not limiting, illustrates two voltage regulators coupled to a single reference voltage in accordance with one embodiment. Circuitry 400 illustrates a manner in which voltage regulators 130*a* and 130*b* of FIG. 1 may be coupled. Voltage regulators 130*a* and 130*b* are similar, if not identical, to voltage regulator 130*a/b* of FIG. 3. The Vref may be supplied to the positive terminal of corresponding voltage regulators 130*a* and 130*b*. It should be appreciated that Vref may be from an identical or common voltage source.

Voltage regulator 130*a* includes op-amp circuit 220*a* and voltage trimming circuit 210*a*. Voltage regulator 130*b* has op-amp 220*b* and voltage trimming circuit 210*b*. Voltage regulators 130*a* and 130*b* generates output voltages Vout1 and Vout2 respectively. Ideally, the Vout1 and Vout2 should be identical to the Vref because of the unity gain amplification factor that is applied by the voltage regulators 130*a* and 130*b*. However, manufacturing variations may cause mismatches between the Vout1 and Vout2 with the Vref.

Voltage trimming circuit 210*a* may trim the Vout1 to be similar, if not identical, with the Vref and voltage trimming circuit 210*b* may trim the Vout2 to be similar, if not identical, with the Vref. The trimming may be performed by activating the current sources 320 and 330 and current sinks 325 and 335 within each of the voltage trimming circuits 210*a* or 210*b*, as described in FIG. 3. It should be appreciated that the trimming of the Vout1 to become equal to the voltage level of Vref or the trimming of Vout2 to be equal to the voltage level of Vref are independent trimming processes and does not affect the Vref. The Vout1 and Vout2 are supplied to the remaining circuits of the IC after being trimmed to the Vref voltage level.

Figure 5:
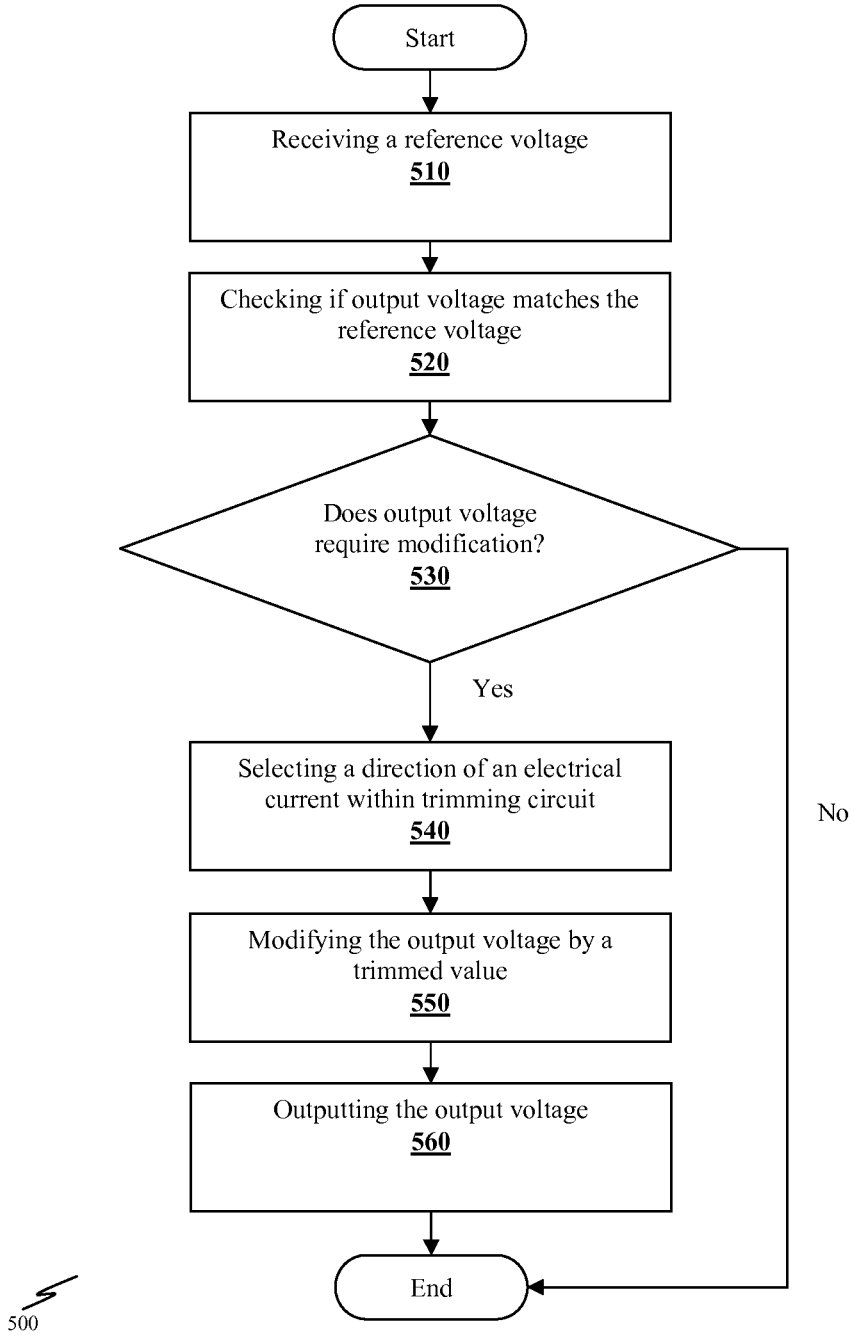
FIG. 5, meant to be illustrative and not limited to, illustrates a method to operate a voltage regulator in accordance with one embodiment.

FIG. 5, meant to be illustrative and not limiting, illustrates method 500 to operate a voltage regulator in accordance with one embodiment. In one embodiment, the voltage regulator may be voltage regulator 130*a/b* of FIG. 3. At step 510, a reference voltage is received by the voltage regulator. In one embodiment, the reference voltage is received from a bipolar junction transistor (BJT) within the IC. In another embodiment, the reference voltage is received from a voltage source that is external to the IC. The reference voltage is at voltage level of approximately of 0.5V to 0.7V, in one embodiment. It should be appreciated that the voltage regulator has a unity gain amplification factor.

At step 520, the output voltage is checked if the output voltage matches with the reference voltage. In one embodiment, the output voltage may not be equivalent with the reference voltage. The mismatch may arise due to plurality of reason, including manufacturing variations. Consequently, at step 530, the output voltage may be determined if required for any modification. If the output voltage does not match with the reference voltage, the output voltage may be deemed to require modification at step 530. Whereas, if the output voltage matches with the reference voltage, then the output voltage may be deemed not to require modification at step 530.

If it is determined if the output voltage needs to be modified, step 540, where by a current source and a current sink within a voltage trimming circuit are activated, is performed. The activation of the current source and sink enables propagation of the electrical current in a selected pathway. In one exemplary embodiment, the selected pathway may trim down the output voltage by a predefined voltage step. In an alternative embodiment, the selected pathway may add up to the output voltage by a predefined voltage. The predefined voltage step may depend on the electrical current generated by a current source, e.g., current source 320 or 330 in FIG. 3, and, the resistance provided by a resistor, e.g., Rtrim 310 in FIG. 3. The voltage trimming circuit may be voltage trimming circuit 210 of FIG. 3 in one embodiment. At step 550, the output voltage is modified by the predefined voltage trim step. In one embodiment, the output voltage is within the predefined range, whereby an IC may perform its functions at an optimum speed and power while maintaining its reliability. Finally, at step 560, the output voltage gets output from the voltage regulator to the remaining circuits. The output voltage may be utilized as supply voltage for the functions defining the IC.

The embodiments, thus far, were described with respect to integrated circuits. The method and apparatus described herein may be incorporated into any suitable circuit. For example, the method and apparatus may be incorporated into numerous types of devices such as microprocessor, programmable logic devices (PLDs), application specific standard products (ASSPs) and application specific integrated circuits (ASICs). Examples of PLDs include programmable arrays logic (PALs), programmable logic arrays (PLAs), field programmable logic arrays (FPLAs), electrically programmable logic devices (EPLDs), electrically erasable programmable logic devices (EEPLDs), logic cell arrays (LCAs), field programmable gate arrays (FPGAs), just name a few.

The programmable logic device described herein may be part of a data processing system that includes one or more of the following components; a processor; memory; IO circuits; and peripheral devices. The data processing can be used in a wide variety of applications, such as computer networking, data networking, instrumentation, video processing, digital signal processing, or any suitable other application where the advantage of using programmable or re-programmable logic is desirable. The programmable logic device can be used to perform a variety of different logic functions. For example, the programmable logic device can be configured as a processor or controller that works in cooperation with a system processor. The programmable logic device may also be used as an arbiter for arbitrating access to a shared resource in the data processing system. In yet another example, the programmable logic device can be configured as an interface between a processor and one of the other components in the system. In one embodiment, the programmable logic device may be one of the family of devices owned by the assignee.

Although the method of operations were described in a specific order, it should be understood that other operation may be performed in between described operations, described operations may be adjusted so that they occur at slightly different times or described operations may be distributed in a system which allows occurrence of the processing operation at various intervals associated with the processing, as long as the processing of the overlay operations are performed in a desired way.

Although the foregoing invention has been described in some detail for the purposes of clarity of understanding, it will be apparent that certain changes and modifications can be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A voltage regulator comprising:

an operational amplifier receiving a reference voltage on a first input terminal, the operational amplifier having an output terminal; and a voltage trim circuit coupled to the output terminal and a second input terminal of the operational amplifier, the voltage trim circuit having a resistor, wherein:

a first terminal of the resistor is coupled to the output terminal and a second terminal of the resistor is coupled to the second input terminal of the operational amplifier, when a first pathway comprising the resistor is selected, a first electrical current passes through the resistor, wherein an initial output voltage of the output terminal is increased by a first predetermined voltage generated across the resistor to yield a first output voltage, and the second terminal of the resistor delivers the first output voltage to the second input terminal of the operational amplifier, and when a second pathway comprising the resistor is selected, a second electrical current passes through the resistor, wherein the initial output voltage is decreased by a second predetermined voltage generated across the resistor to yield a second output voltage, and the second terminal of the resistor delivers the second output voltage to the second input terminal of the operational amplifier.

2. The voltage regulator in claim 1, wherein the initial output voltage is modified by a dynamic amount of voltage, wherein the dynamic amount of voltage is directly proportional to the electrical current.

3. The voltage regulator in claim 1, wherein the voltage trim circuit further comprises:

a first current source, wherein the first current source receives a supply voltage on the a first terminal of the first current source, and a second terminal of the first current source is coupled to the first terminal of the resistor;

a first current sink coupled to the second terminal of the resistor, wherein the first electrical current generated from the first current source propagates through the resistor to ground via the first current sink, and wherein the resistor, the first current source, and the first current sink are disposed on the first pathway;

a second current source, wherein the second current source receives a supply voltage on a first terminal of the second current source, and a second terminal of the second current source is coupled to the second terminal of the resistor; and a second current sink coupled to the first terminal of the resistor, wherein the second electrical current generated from the second current source propagates through the resistor to ground via the second current sink, and wherein the resistor, the second current source, and the second current sink are disposed on the second pathway.

4. The voltage regulator in claim 3, wherein when the first current source and the first current sink are activated, the second current source and the second current sink are deactivated.

5. The voltage regulator in claim 3, wherein the first electrical current generated from the first current source is equivalent to an electrical current propagating to the ground via the first current sink, and wherein the second electrical current generated from the second current source is equivalent to an electrical current propagating to the ground via the second current sink.

6. The voltage regulator in claim 3, wherein an amount of the first electrical current generated by the first current source and an amount of the second electrical current generated by second current are programmable.

7. A voltage trim circuit comprising:

a resistor, a first terminal of the resistor receiving an initial output voltage of an operational amplifier, a second terminal of the resistor delivering either a first output voltage or a second output voltage to a negative input of the operational amplifier;

a first current source coupled to the first terminal of the resistor;

a first current sink coupled to the second terminal of the resistor, wherein when a first pathway comprising the resistor is selected, a first programmable electrical current generated from the first current source propagates through the resistor to ground via the first current sink, the initial output voltage is increased by a first predetermined voltage generated across the resistor to yield the first output voltage, and the second terminal of the resistor delivers the first output voltage to the negative input of the operational amplifier;

a second current source coupled to the second terminal of the resistor; and a second current sink coupled to the first terminal of the resistor, wherein when a second pathway comprising the resistor is selected, a second programmable electrical current generated from the second current source propagates through the resistor to ground via the second current sink, the initial output voltage is decreased by a second predetermined voltage generated across the resistor to yield the second output voltage, and the second terminal of the resistor delivers the second output voltage to the negative input of the operational amplifier.

8. The voltage trim circuit in claim 7, wherein the voltage trim circuit is integrated into a voltage regulator.

9. The voltage trim circuit in claim 8, wherein the voltage trim circuit is integrated into a feedback loop of the voltage regulator.

10. The voltage trim circuit in claim 7, wherein the resistor, the first current source, and the first current sink are disposed on the first pathway, and the resistor, the second current source, and the second current sink are disposed on the second pathway.

11. The voltage trim circuit in claim 7, wherein the first current source and the first current sink are activated when the second current source and the second current sink are deactivated.

12. The voltage trim circuit in claim 7, wherein the operational amplifier is coupled to a voltage reference source.

13. The voltage trim circuit in claim 7, wherein the first programmable electrical current generated from the first current source and the second programmable electrical current generated from the second current source are selected based upon fuse settings.

14. The voltage trim circuit in claim 12, wherein a final output voltage of the operational amplifier is between about 0.5V to 0.7V.

15. A method to operate a voltage regulator, comprising:

receiving a reference voltage at a first input terminal of an operational amplifier (op-amp);

determining whether an initial output voltage of the op-amp requires a voltage level modification;

in response to a determination that the initial output voltage of the op-amp requires a voltage level modification, selecting a direction of an electrical current to propagate within a voltage trim circuit to enable trimming of the initial output voltage of the op-amp, the voltage trim circuit having a resistor;

when a first pathway comprising the resistor is selected, increasing the initial output voltage by a first predetermined voltage generated across the resistor to yield a first output voltage, wherein a first electrical current passes through the resistor, a first terminal of the resistor receives the initial output voltage of the op-amp, and a negative input terminal of the op-amp receives the first output voltage of a second terminal of the resistors;

when a second pathway comprising the resistor is selected, decreasing the initial output voltage by a second predetermined voltage generated across the resistor to yield a second output voltage, wherein a second electrical current passes through the resistor, and the negative input terminal of the op-amp receives the second output voltage of the second terminal of the resistor; and outputting a final output voltage of the op-amp through an output terminal of the op-amp.

16. The method in claim 15, wherein the method further comprises:

receiving a feedback voltage on the negative input terminal of the op-amp, wherein the feedback voltage is fed back from the output terminal, and wherein the feedback voltage is modified by the first electrical current or the second electrical current to enable the trimming by the first predetermined voltage or the second predetermined voltage.

17. The method in claim 15, further comprising:

increasing the initial output voltage by the first predetermined voltage so that the final output voltage is substantially equivalent to the reference voltage.

18. The method in claim 15, further comprising:

decreasing the initial output voltage by the second predetermined voltage so that the final output voltage is substantially equivalent to the reference voltage.

19. The method in claim 15, further comprising:

when the first pathway comprising the resistor is selected:

activating a first current source and a first current sink to enable propagation of the first electrical current across the first pathway, and trimming the initial output voltage by the first predetermined voltage, wherein the first predetermined voltage is equivalent to a product of the first electrical current and a resistance of the resistor; and when the second pathway comprising the resistor is selected:

activating a second current source and a second current sink to enable propagation of the second electrical current across the second pathway, and trimming the initial output voltage by the second predetermined voltage, wherein the second predetermined voltage is equivalent to a product of the second electrical current and the resistance of the resistor.

20. The method in claim 19, further comprising:

determining an amount of the first electrical current generated by the first current source and an amount of the second electrical current generated by the second current source based on fuse settings.

21. The method in claim 15, further comprising:

applying a voltage source to the voltage regulator to generate a constant electrical current within one of a current source and a current sink.

* * * * *